United States Patent [19]

Dalsin

[11] 4,186,719

[45] Feb. 5, 1980

[54] AIR SUPPLY DEVICE FOR FIREPLACES

[75] Inventor: Bernard L. Dalsin, Edina, Minn.

[73] Assignee: Bernard Dalsin Manufacturing Company, Bloomington, Minn.

[21] Appl. No.: 834,164

[22] Filed: Sep. 19, 1977

[51] Int. Cl.[2] ..... F24B 13/02

[52] U.S. Cl. ..... 126/143; 126/120

[58] Field of Search ..... 126/120, 288, 143, 135, 126/138, 140; 98/32, 37, 40, 40 M, 102; 110/163, 175, 310; 16/191, 140; 292/202

[56] References Cited

U.S. PATENT DOCUMENTS

| | | | |
|---|---|---|---|
| 162,958 | 5/1875 | Shontz | 292/202 |
| 1,326,333 | 12/1919 | Frank | 16/140 |
| 1,609,518 | 12/1926 | Larson | 16/140 |
| 2,470,430 | 5/1949 | Carter | 126/143 |

FOREIGN PATENT DOCUMENTS

| | | | |
|---|---|---|---|
| 676985 | 8/1952 | United Kingdom | 126/143 |
| 744169 | 2/1956 | United Kingdom | 126/143 |
| 856876 | 12/1960 | United Kingdom | 126/288 |

*Primary Examiner*—Lloyd L. King
*Assistant Examiner*—Harry Tanner
*Attorney, Agent, or Firm*—James R. Haller

[57] ABSTRACT

A device for supplying cold outside air of controlled volume and direction to a fireplace. The device includes a housing carrying an adjustable volume damper and direction damper for controlling the volume and direction of air flow from the device. Means are provided for maintaining the desired position of the direction damper and for limiting the directionality thereof.

9 Claims, 5 Drawing Figures

AIR SUPPLY DEVICE FOR FIREPLACES

BACKGROUND OF THE INVENTION

Fireplaces which are constructed in residences have long been considered highly wasteful of energy. Inside air which has been warmed by a furnace or the like is normally drawn up the flue at a rather rapid rate, and is also used as primary combustion air for the fire in the fireplace. It has been contemplated that the overall effect of a fire in a common fireplace is a net loss of heat from a dwelling.

Many ideas and devices have been proposed to reduce or eliminate this wasteful loss of warm air from a dwelling. Certain devices have attempted merely to place large quantities of iron within the fireplace which, when heated, would radiate heat into a room. Other devices have provided convection tubes mounted within the firebox for picking up cold air near the floor of the room, heating the air (and establishing convection), and exhausting the heated air back into the room. Yet, other devices have involved the use of ductwork of various sizes and types for drawing cold air from outside a dwelling and expelling it into the fireplace for use as a primary combustion air, thereby avoiding, at least to some extent, the loss of hot air from the dwelling. Examples of the latter devices are found in U.S. Pat. Nos. 2,740,398 and 3,976,048. The devices thus depicted were rather bulky and involved, were generally difficult to install, and do not appear to have met with commercial success. Moreover, since proper flue action requires an air flow of large proportions, significant quantities of heated air from within a dwelling were yet required to provide proper flue action.

It would be highly beneficial to provide a device for controllably drawing cold, outside air into a fireplace, with sufficient cold air thus being drawn in a controlled manner as to largely eliminate the loss of heated air from within a room.

SUMMARY OF THE INVENTION

The present invention provides a device for supplying cold outside air of controlled volume and direction to a fireplace. The cold air may be used as primary air for a fire, or may be used to supply the air necessary to maintain proper flue operation, or both. The device comprises a housing having an air inlet and outlet, adjustable volume damper means carried by the housing for controlling the flow rate of air through the device, adjustable direction damper means for controlling the direction of cold air from from the device into a fireplace, and means for maintaining the position of the direction damper means including limit means positively limiting the directionality of the air flow from the device to insure that such air is directed within the fireplace.

In its preferred embodiment, the housing is generally parallelpiped in shape and has an open bottom and top providing an air inlet and outlet, respectively. A pivotal damper plate mounted to an axle journaled into opposed walls of the housing provides a volume damper. A top cover, hinged at one edge to an upper edge of the housing to open and close upon the air outlet serves as the direction damper. The cover may have an inner surface which is at least partially reflective of radiation to prevent overheating and consequent warpage of the cover. A latch bar is mounted interiorly of the housing, and attached to the cover and extending inwardly of the housing is a friction plate frictionally engaging the latch bar to restrain the cover from moving from its desired position. The friction plate includes a stop contactable with the latch bar to limit the degree that the cover can be opened. An exteriorly operable handle is coupled to the volume damper plate to control the position of the latter, the handle frictionally engaging a friction surface carried by the housing to restrain the volume damper from moving from a desired position. A poker-engageable latch extends rotatably through the cover and terminates inwardly in an end which may be rotated beneath the latch bar to lock the cover shut.

The direction and volume dampers operate in a manner complimentary to one another. The direction damper directs air, as desired, preferentially onto the fuel within the fireplace to encourage good combustion or preferentially in front of and over the burning fuel where it is heated and supplies sufficient air volume for good flue operation. In the latter position, the stream of air issuing from the device may serve, in effect, as an air curtain across the open front of the fireplace.

DESCRIPTION OF THE PREFERRED EMBODIMENT

Figure 2:
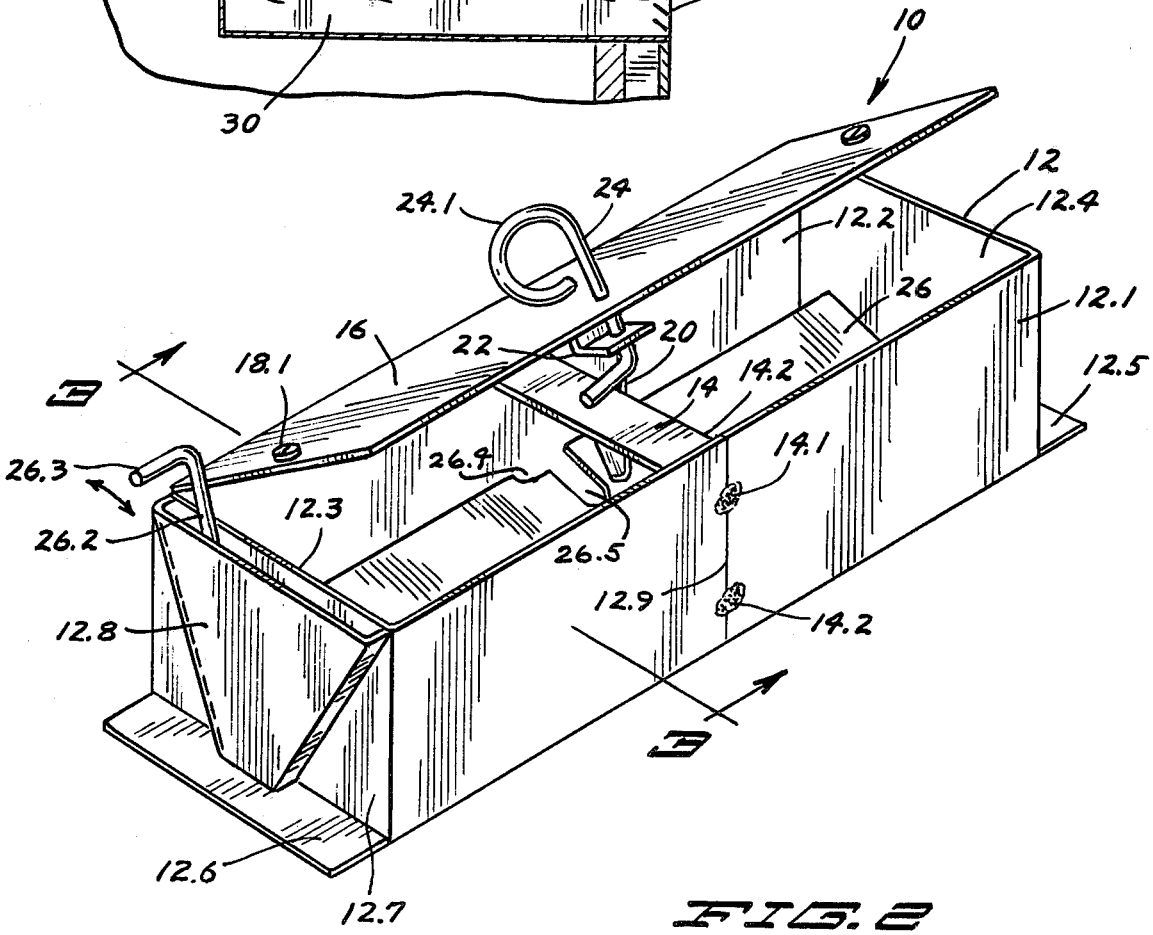
FIG. 2 is a perspective view of the device of the invention with the volume and direction dampers partially open.

The device of the invention is depicted generally in FIG. 2 as 10, and includes a housing 12 of an elongated, parallelepiped shape. The housing includes rear and front walls 12.1, 12.2 and end walls 12.3, 12.4, the walls defining an air conduit of generally rectangular cross-section and having an open top and bottom. Extending outwardly from the end walls are mounting flanges 12.5, 12.6. A latch bar 14 extends between the front and rear walls near their upper edges and intermediate the end walls. The ends of the latch bar are received in aligned slots in the front and rear walls of the housing (for ease of manufacturing) and are welded to the front and rear walls as shown at 14.1. The latch bar may be a strap of heavy metal having its smallest dimension in the vertical direction.

A direction damper is illustrated in the form of a cover 16 which has length and width dimensions approximating the length and width dimensions of the open top of the housing. As shown best in FIG. 3, the cover is pivotally attached along one of its longer edges to the upper edge of the front housing wall 12.2 by means of a hinge 18. The hinge desirably extends along the entire adjacent edges of the cover and front wall to lend stability to the device, and may be attached to the cover and wall by screws 18.1 or spot welds or the like.

Figure 5:
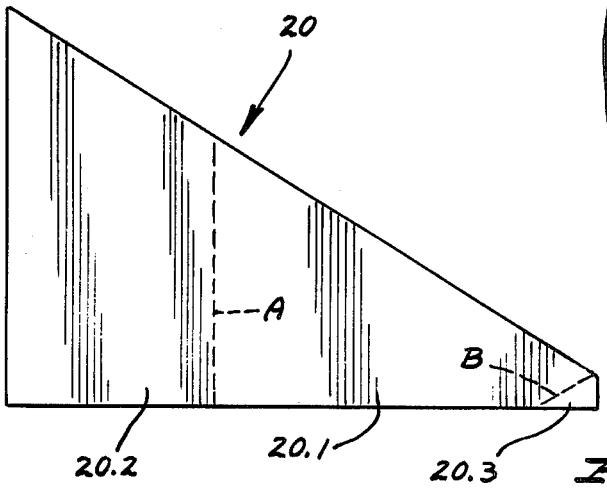
FIG. 5 depicts a pattern for manufacture of a part of the device of FIG. 2.

Attached to the cover intermediate its length and extending inwardly of the housing is a friction plate 20. The friction plate is desirably of stainless steel or other springy material, as will be described in more detail below, and may be made from a generally triangular "blank" of material as shown in FIG. 5. The ends of the blank are bent upwardly (toward the reader) along the bend lines designated "A" and "B", thus providing the friction plate with a generally triangular and flat central portion 20.1, a broad leg 20.2, and a comparatively small stop or finger 20.3.

Figure 3:
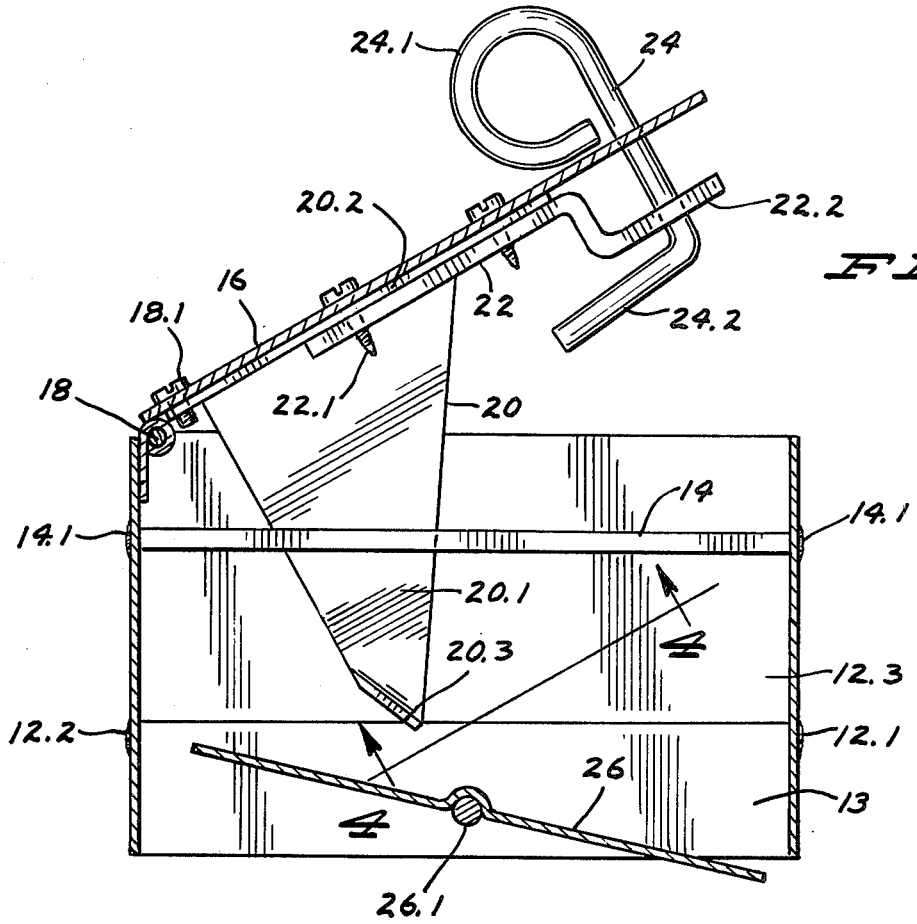
FIG. 3 is a cross-sectional view taken along line 3—3 of FIG. 2.
Figure 4:
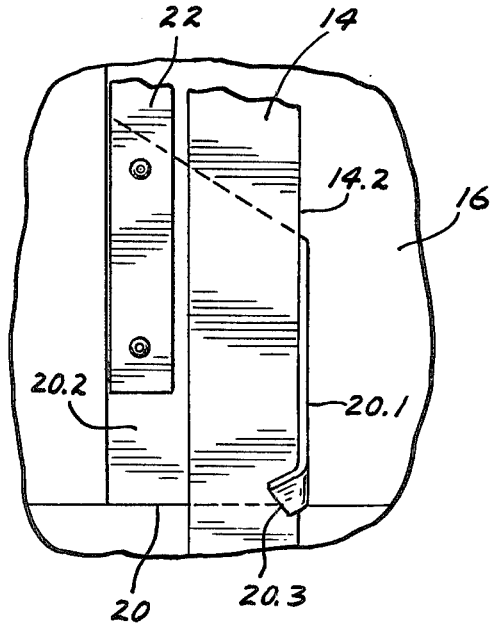
FIG. 4 is a broken-away view taken along 4—4 of FIG. 3.

Referring now to FIGS. 3 and 4, the broad leg 20.2 of the friction plate is welded or bolted or otherwise affixed to the inner surface of the cover 16 so that the central portion 20.1 of the friction plate extends alongside and comes into frictional contact with the edge 14.2 of the latch bar 14. The bend designated "A" in FIG. 6 contributes to the springy nature of the central portion 20.1. The stop 20.3 at the narrow end of the friction plate is configured so that its inner, flat surface comes into abutting relationship with the lower surface of the latch bar 14 when the cover has been raised to a predetermined position, the stop preventing the cover from being raised further.

A bracket 22, which may be made of heavy metal strapping, is affixed by means of screws to the cover, the screws passing through the friction plate and thence being threaded into the bracket. The end portion of the bracket is bent in a "Z" shaped configuration as shown best in FIG. 3, and terminates in a section 22.2 spaced below the cover 16. A latch, shown generally as 24, passes through aligned apertures in the cover and bracket section 22.2, and is freely rotatable therein. The latch may be made of heavy gauge wire, and has a large loop 24.1 at its outer end which can easily be engaged by pokers of the type in common use with residential fireplaces. The inner end 24.2 of the latch is bent so as to make a slightly obtuse angle with the portion of the latch passing through the apertures to form a locking leg. When the cover is tightly closed, the locking leg can be urged beneath the latch bar 14 by rotation of the looped portion 24.1 of the handle to lock the cover in its shut position. It will thus be understood that the cover can be manipulated between its open and closed, and its locked and unlocked, positions through the use of a common poker inserted in the loop 24.1.

A volume damper plate 26, illustrative of volume damper means, is provided with length and width dimensions slightly less than the length and width of the bottom opening in the housing. An axle 26.1 (FIG. 3) is journaled at its ends for rotation into the opposed end walls 12.3, 12.4 adjacent the bottom edges of these walls and intermediate the side walls 12.1, 12.2, or desirably into receptive apertures in upwardly turned portions of the flanges 12.5, 12.6, one portion being shown as 13 in FIG. 3. The plate 26 is provided with a rounded center groove in which the axle 26.1 is attached by spot welding or the like. The volume control plate 26 is also provided with recesses 26.4, 26.5 in one of its edges so that the plate can be rotated into a position approaching the vertical with the recesses accomodating the latch bar 14 and the friction plate 20. The axle has a generally right angled bend at one end to provide a generally upwardly extending leg 26.2 (FIG. 2). An end plate 12.7, having length and width dimensions approximating those of the end wall 12.3, is welded or otherwise affixed to the end wall 12.3. The plate 12.7 is provided with an upwardly-open, pie slice-shaped recessed portion 12.8, and the end 26.2 of the axle is permitted to move within the recess forwardly and rearwardly as shown in FIG. 2. The axle portion 26.2 terminates in an outwardly directed handle portion 26.3 for manually moving the portion 26.2 back and forth, which, as will be understood, causes the volume damper plate 26 to pivot about the axle between generally open and generally closed positions. For ease of fabrication, the edges of the volume damper plate 26 terminate short of the adjacent walls of the housing, so that even when the plate is in a substantially horizontal position, the volume of air flowing through the housing is not completely shut off.

The upwardly bent portion 26.2 of the axle is in frictional contact with the recessed inner friction surface of the end plate 12.7, and rubs or scrapes against that surface as the axle is rotated to vary the position of the volume damper plate 26. In this manner, once the volume damper plate has been set to a desired position, it is restrained in that position until again manually moved.

The housing of the device desirably is made of 16 gauge steel provided with a blackened surface. In a preferred method of manufacture of the housing, a steel strip having a width equal to the desired height of the housing is appropriately bent to provide the four right-angled housing corners, the ends of the strip meeting at joint 12.9 at the center of the rear wall 12.1 and there joined by weldments 14.1, 14.2. The latch bar 14 and latch bracket 22 may be made of $\frac{1}{8}''$ steel strapping, and the axle 26.2 and latch 24 may be made of round steel rod stock having a diameter of 3/16". The friction plate 20 is desirably made of 18 gauge stainless steel to prevent the friction plate from rusting to the latch bar 14. Thus, desirably either the friction plate on the latch bar or both are of non-rusting material. During manufacture of the friction plate 20, the bend which is formed at line "A" (FIG. 5) provides an acute angle of about 80° between the central portion 20.1 and the broad leg 20.2 thereof. In a preferred embodiment, the housing (not including mounting flanges) may be $13\frac{1}{2}''$ in length, $4\frac{1}{2}''$ in width, and $2\frac{3}{4}''$ in height, thereby enabling the device to easily fit in existing or newly built fireplaces. The cover 16 desirably is made of 14 gauge steel which has a galvanized surface. The cover surface is preferably also etched slightly so that it will accept paint if painting of the cover is desired. The unpainted cover thus has a somewhat grayish color which is at least partially reflective of heat radiation, and which approximates the color of ashes in the fireplace. The surface of the cover which confronts the interior of the housing thus serves to reflect heat radiation and prevents the cover from becoming overly hot which could cause warping. The grayish exterior surface of the cover, which is the only significant portion of the device which is visible from outside the fireplace, tends to camouflage the device since the cover will be viewed against a background of ashes having approximately the same color.

Figure 1:
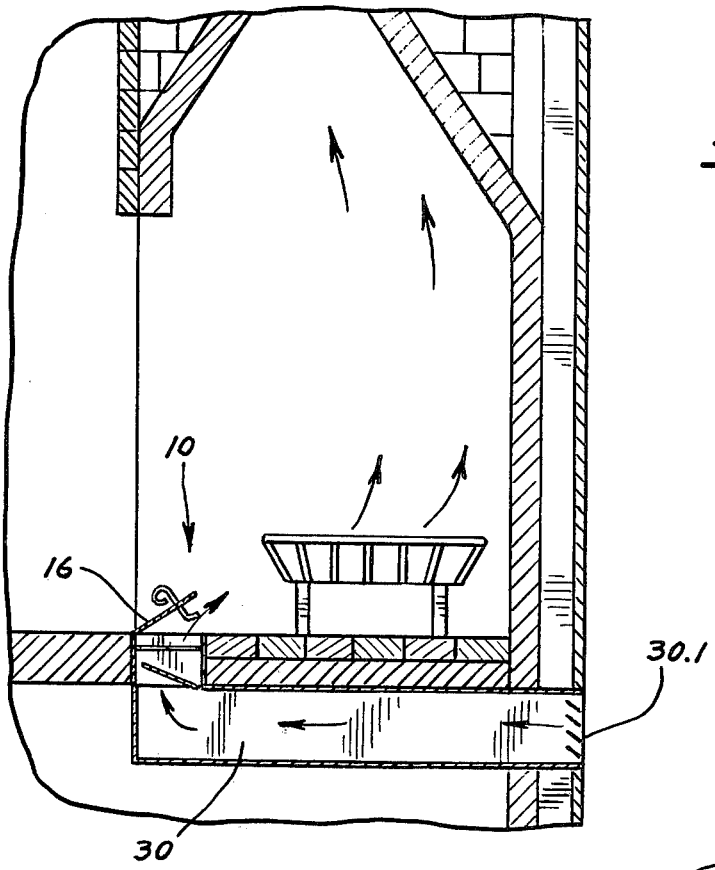
FIG. 1 is a schematic view of a device of the invention installed in a fireplace.

The device desirably is installed in the floor of a fireplace near the very front thereof, as shown in FIG. 1. A duct 30 of sheet metal or the like is provided beneath the floor of the fireplace, and communicates the device of the invention with cold air at the exterior of a building. To improve air flow to the device, the duct desirably has a cross-sectional area available for flow which is greater than the cross-sectional area of the device, and is of a minimum practical length. The exterior opening of the duct 30 desirably is covered with a grill 30.1 which may have louvers and an exterior screen as a barrier against debris, insects and the like.

In operation, exterior cold air which enters the device through the conduit 30 is controlled as to volume by appropriately setting the volume damper 26, and is deflected within a fireplace as desired by the direction damper 16. When the direction damper 16 is only slightly opened, cold air will be directed toward the rear of the fireplace, passing up and through burning logs or the like in the grate to provide combustion air. When the direction control damper 16 is opened until the stop 20.3 encounters the latch bar 14, cold air is directed less forcefully through the logs or other fuel, and is preferentially directed in front of the fire but at an angle within the fireplace, such air being warmed by the fire and thence passing upwardly into the flue. The rate of burning of fuel within the fireplace can thus be controlled and the demands of the flue are substantially met by cold air from outside of the dwelling, little if any previously heated air from within the dwelling thus being drawn up the flue. As will be understood from the previous description, the volume damper 26 pivots in a direction to supply cold air against the direction damper 16 so as to improve the directional control exercised by the direction damper. Moreover, since the edges of the volume damper 26 are spaced inwardly slightly from the walls of the housing, the volume damper itself does not operate to completely seal off the flow of cold air through the device; rather, this function is performed by the direction damper when the latter is moved to its fully closed position. In this manner, the closely adjacent volume and control dampers cooperate in controlling both the volume and direction of air through the device in a highly satisfactory manner.

The stop 20.3 at the lower end of the friction plate 20 coacts with the latch bar 14 to prevent the direction damper from being opened to the point where cold air can be directed into the interior of a dwelling. The frictional engagement between the friction plate and latch bar and between the upwardly bent axle portion of the volume control damper and the end plate 12.7 permits the positions of these dampers to be set and maintained constant during operation of the device until it is desired to manually readjust the dampers. The large loop 24.1 in the latch 24, and the outwardly directed end 26.3 of the upwardly bent axle portion permit the direction and volume dampers to be easily operated by means of hand-held fireplace utensils such as pokers.

Thus, manifestly, I have provided an inexpensive, compact device which permits a fireplace to be operated with cold, exterior air from without a dwelling, the cold air being carefully controlled by closely adjacent, coacting volume and direction dampers to control the volume and direction of the cold air supplied to the fireplace. Controls for the dampers are easily accessible and may be operated by common fireplace utensils. The volume and direction dampers are maintained in their desired positions by static friction forces until further adjustments are manually made in the positions of these dampers.

While I have described a preferred embodiment of the present invention, it should be understood that various changes, adaptations, and modifications may be made therein without departing from the spirit of the invention and the scope of the appended claims.

What is claimed is:

1. An air supply device for a fireplace comprising a housing installable forwardly of the fireplace and having an air inlet and outlet, adjustable volume damper means carried by the housing for controlling the volume of air passing through the housing, an independently adjustable direction damper means carried by the housing for receiving air controlled by the volume damper means and for controlling the direction of air flow from the device toward the fireplace, the volume damper means being closely adjacent the direction damper means and adjustable to deflect air toward the direction damper means, and means for maintaining the position of the direction damper means, the position-maintaining means including limit means positively limiting the adjustability of the direction damper means thereby to insure that air flowing through the device is directed within a fireplace.

2. The device of claim 1 wherein the direction damper means comprises a direction damper pivotally mounted to the housing to open and close upon the air outlet, the direction damper having an inner surface which confronts the housing interior and which is at least partially reflective of heat radiation to prevent undue heating of the direction damper.

3. The device of claim 2 wherein the position-maintaining means includes a latch bar carried interiorly of the housing intermediate its ends and a friction plate mounted to the direction damper and extending interiorly of the housing, the friction plate continuously frictionally engaging the latch bar as the direction damper is adjusted for directionality, said frictional engagement restraining the direction damper from pivotal movement.

4. The device of claim 3 wherein the limit means comprises a stop carried by the friction plate and positioned to abut the latch bar as the direction damper is pivoted away from the air outlet and to positively prevent further opening of the direction damper.

5. The device of claim 3 wherein at least one of the friction plate and latch bar are of non-rusting material.

6. An air supply device for a fireplace comprising a housing having an air inlet and outlet, an adjustable volume damper pivotally mounted within the housing to control the volume of air flowing to the outlet, an independently adjustable direction damper pivotally mounted to the housing to open and close upon the air outlet of the latter and positioned closely adjacent the volume damper to receive air therefrom and to control the direction of air issuing from the device, the volume damper being so adjustable as to deflect air toward the direction damper, a latch bar mounted in the housing, a friction plate carried by the direction damper and extending into the housing in frictional engagement with the latch bar to restrain pivotal movement of the direction damper, a stop carried by the friction plate and engagable with the latch bar to limit pivotal movement of the direction damper, and a rotatable latch carried by the direction damper and having an external loop engagable by a poker to adjust the direction damper, the latch having locking means engagable with the latch bar in response to rotation of the latch to lock the direction damper in a closed position upon the air outlet.

7. The device of claim 6 wherein at least one of the friction plate and latch bar are of non-rusting material.

8. The device of claim 6 wherein the direction damper has an interior surface which confronts the housing interior and which is at least partially reflective of heat radiation.

9. The device of claim 2 wherein the direction damper means includes a rotatable latch carried by the direction damper and having an external loop engageable by a poker to adjust the volume damper, the latch having locking means engagable with the latch bar in response to rotation of the latch to lock the direction damper in a closed position with respect to the air outlet.

* * * * *